US010483078B2

(12) United States Patent
Roger et al.

(10) Patent No.: US 10,483,078 B2
(45) Date of Patent: Nov. 19, 2019

(54) ANODE STACK

(71) Applicant: Oxford Instruments X-ray Technology, Scotts Valley, CA (US)

(72) Inventors: Joseph Roger, Sunnyvale, CA (US); Charles L. Fowler, Scotts Valley, CA (US); Mahendran Chidambaram, Saratoga, CA (US); Yahya Alivov, Scotts Valley, CA (US)

(73) Assignee: Oxford Instruments X-ray Technology, Inc., Scotts Valley, CA (US)

( * ) Notice: Subject to any disclaimer, the term of this patent is extended or adjusted under 35 U.S.C. 154(b) by 323 days.

(21) Appl. No.: 15/494,173

(22) Filed: Apr. 21, 2017

(65) Prior Publication Data

US 2018/0053623 A1 Feb. 22, 2018

(51) Int. Cl.
*H01J 35/12* (2006.01)

(52) U.S. Cl.
CPC ..... *H01J 35/12* (2013.01); *H01J 2235/081* (2013.01); *H01J 2235/1204* (2013.01); *H01J 2235/1291* (2013.01); *H01J 2235/165* (2013.01)

(58) Field of Classification Search
CPC ..... H01J 35/12; H01J 2235/081; H01J 2235/1204; H01J 2235/1291; H01J 2235/165
See application file for complete search history.

(56) References Cited

FOREIGN PATENT DOCUMENTS

CN 204215999 U * 3/2015

* cited by examiner

*Primary Examiner* — Mark R Gaworecki
(74) *Attorney, Agent, or Firm* — Blank Rome LLP

(57) ABSTRACT

There is provided an anode stack for cooling and electrically insulating a high voltage anode of an X-ray device. The anode stack has at least a conductor member and a dielectric member, and the conductor member has a main body and a peripheral portion. The dielectric member overlies and couples with the main body of the conductor member at one surface. At an opposing surface of the main body of the conductor member, an end of the high voltage anode is coupled thereto in use. The peripheral portion of the conductor member has an annular region that surrounds at least a part of the dielectric member and which is spaced therefrom.

25 Claims, 4 Drawing Sheets

ANODE STACK

TECHNICAL FIELD

The present invention relates to an anode stack and in particular it relates to an anode stack for cooling and electrically insulating a high voltage anode of an X-ray device.

BACKGROUND OF THE INVENTION

An X-ray tube is a type of vacuum tube that converts electrical power into X-rays. In such devices, the cathode is a negatively charged electron emitter and the anode is a positively charged electron collector. Between the cathode and the anode, a flow of electrical current is established using a high voltage power source, typically between 4 kV and 500 kV, which accelerates the electrons in their path. However, efficiency of the X-ray tube is very low and the yield of X-ray production is usually less than 1%, with the remaining 99% of the input energy being converted into heat.

The excess heat that is produced in the X-ray tube must be removed from the high voltage anode in order to prevent the device from overheating and to enable continuous operation. Thus, thermal management of this generated heat is an important consideration in the design and manufacture of X-ray tubes in addition to the electrical insulation considerations. For example, the high voltage anode must be electrically isolated from mechanical components of the X-ray tube including the mechanical support, and at the same time be capable of removing excess heat.

In the past, in order to avoid overheating, X-ray tubes have been immersed in cooling fluids such as oil that are capable of heat transfer through a process of heat convection and which have high dielectric strength so that heat is dissipated away from high voltage anode as the cooling fluid circulates. More recently, it has been proposed to use anode stacks that sit between the high voltage anode and the mechanical support and which are made from materials that are both electrically insulating and thermally conductive in order to achieve the same cooling effect but without the burden and constraints of a liquid coolant.

In some anode stack designs, a dielectric disc of high thermal conductivity is sandwiched between two metallic discs, also of high thermal conductivity, one of which is coupled to the high voltage anode, and the other of which is coupled to a heat sink. In these devices, the high thermal conductivity of the dielectric and metallic discs allows effective heat transfer away from the high voltage anode.

However, this design has a number of drawbacks related to high electric fields at the triple point region, i.e. the region where the dielectric, metal and vacuum meet; the electric field at the triple point regions of traditional anode stacks can be much greater than the surrounding electric field depending on the geometry of the component parts of the anode stack and the dielectric constants of the materials. These locally intensified electric fields are often the cause of electrical arcing and electrical breakdown that ultimately leads to device failure.

SUMMARY OF THE INVENTION

The present inventors have recognised that an improved and more reliable anode stack is required, which provides for reduced electrical arcing and electrical breakdown in the X-ray device.

Thus, viewed from one aspect of the present invention, there is provided an anode stack for cooling and electrically insulating a high voltage anode of an X-ray device, the anode stack comprising: a conductor member and a dielectric member, the conductor member having a main body and a peripheral portion, wherein the dielectric member overlies the main body of the conductor member, wherein the main body of the conductor member is arranged to couple with the dielectric member at one surface, and with an end of the high voltage anode at an opposing surface in use, and wherein the peripheral portion of the conductor member comprises an annular region that surrounds at least a part of the dielectric member and which is spaced therefrom.

As defined above, in its most basic configuration, the conductor-dielectric arrangement of the anode stack of the present invention is intended to be inserted between the high voltage anode and a mechanical support of the X-ray device. The anode stack may also separate the high voltage anode from the high voltage potential of the X-ray device, a heat exchanger and/or a ground plane.

The dielectric member overlies the main body of the conductor member in the sense that the surface of the main body of the conductor member that couples with the dielectric member is the geometric projection of the surface of the dielectric member that couples with the main body of the conductor member. In other words, the footprint of the dielectric member is the same as the main body of the conductor member.

The dielectric member does not overlie the peripheral portion of the conductor member, i.e. the peripheral portion is the part which is not encompassed by the main body and it includes an annular region that encircles the main body.

The shape of the anode stack at the peripheral portion of the conductor member is critical for reducing the electric field at the triple point region; the annular region that surrounds at least a part of the dielectric member and which is spaced therefrom provides screening and thus reduces electrical arcing and electrical breakdown at the triple point region. Accordingly, the reliability of the anode stack of the present invention is greatly increased compared to previous versions whilst maintaining its ability to remove heat from the high voltage anode at a very high rate and act as an electrical insulator.

It is preferable that the annular region of the peripheral portion of the conductor member surrounds a joining region between the dielectric member and the main body of the conductor member, the surface perimeter of said joining region preferably coinciding with the triple point region of the anode stack. Thus, the shape of the anode stack at the peripheral portion of the conductor member reduces the electric field at the joining region. Preferably, the joining region has a perimeter surface comprising surfaces of the dielectric member and of the main body of the conductor member.

Thus, when travelling along the perimeter surface of the dielectric member within the joining region to reach the perimeter surface of the main body of the conductor member within the joining region, or vice versa, the path taken is smooth and does not involve any sharp angles. The path may advantageously be substantially linear, or in other words, the surface of the dielectric member within the joining region and the surface of the main body of the conductor member within the joining region are at 180 degrees to one another.

In a particularly preferred embodiment, the joining region is cylindrically shaped. In this arrangement as well as other prismatically shaped arrangements of the joining region, all normal axes to the perimeter surface of the joining region may be coplanar or lie in parallel planes. As a result, the electric field in the joining region is reduced further by the removal of sharp edges in said region.

An anode stack direction may be defined from the dielectric member to the conductor member along a major axis shared by the dielectric member and the conductor member. Therefore, the perimeter surface of the joining region may coincide with the stack direction.

The annular region of the peripheral portion of the conductor member may define a trench in the conductor member that extends in the anode stack direction. Advantageously, the trench removes any sharp angles from the joining region and so the electric field in this region is reduced even further by virtue of the shape of the trench. More preferably, the trench height may be at least equal to the trench width and yet more preferably, the trench height may be substantially equal to the trench width. These trench dimensions have been selected in such a way that electric field at the triple point region is reduced by at least two times compared to the case when no trench is used.

The dielectric member and the main body of the conductor member may each be prismatically shaped. However, in a particularly preferred embodiment, the dielectric member and the main body of the conductor member are each cylindrically shaped, and not just at the joining region. Thus, the entire external surface perimeter of the dielectric member and the main body of the conductor member have no sharp edges and so the electric field in the proximity of these anode stack parts is greatly reduced compared with an anode stack having sharp interface regions between the dielectric member and the main body of the conductor member.

The ratio of thermal expansion coefficient between the conductor member to the dielectric member is preferably less than or equal to 3:1, in particular, when the ratio of conductor to dielectric thickness is 1:2. This reduces the mechanical stress imparted on the anode stack.

The anode stack may further comprise an attachment member arranged on an opposing surface of the conductor member to that which couples with the dielectric member, for attachment with the high voltage anode in use. Mechanically, an attachment member advantageously provides much more support between the conductor member and the high voltage anode than mere placement of the high voltage anode onto the anode stack, for example. Preferably, this attachment member may be a metal screw, which allows heat transfer from the high voltage anode to the conductor member and/or the dielectric member via the attachment member.

The conductor member, that is, either one of or both of the main body and the peripheral portion, preferably comprises a material having thermal conductivity above 20 $Wm^{-1}K^{-1}$. Suitable conductor member materials include but are not limited to tungsten, molybdenum and copper, or alloys thereof.

The dielectric member preferably also comprises a material having thermal conductivity above 20 $Wm^{-1}K^{-1}$. Suitable dielectric member materials include but are not limited to aluminium nitride (AlN), aluminium oxide ($Al_2O_3$), beryllium oxide (BeO) and diamond.

The anode stack may further comprise a brazing, gluing or soldering material between the main body of the conductor member and the dielectric member for joining the main body of the conductor member and the dielectric member. These techniques for attaching the main body of the conductor member to the dielectric member are advantageous over other attachment techniques, such as bolting, which are not as practical for joining dissimilar materials. Some examples of suitable braze materials include copper, Cusil and Nichoro. However, the braze materials are not limited to these, and depending on whether the dielectric member insulator is coated or uncoated, active or non-active braze materials may be used.

In some examples, the anode stack may further comprise a base conductor member arranged to couple with an opposing surface of the dielectric member to that which couples with the main body of the conductor member. This results in a conductor-dielectric-conductor arrangement of the anode stack.

Preferably, the base conductor member has a main body and a peripheral portion, wherein the dielectric member overlies the main body of the base conductor member, wherein the main body of the base conductor member is arranged to couple with the dielectric member, and wherein the peripheral portion of the base conductor member comprises an annular region that surrounds at least part of the dielectric member and which is spaced therefrom. In effect, the shape of the base conductor member may comprise many similarities with the shape of the conductor member.

Similarly to the shape of the anode stack at the peripheral portion of the conductor member, the shape of the anode stack at the peripheral portion of the base conductor member also reduces the electric field at the triple point region formed at its interface with the dielectric member and the vacuum of the X-ray device; the annular region that surrounds at least a part of the dielectric member and which is spaced therefrom provides screening and thus reduces electrical arcing and electrical breakdown at the triple point region.

In some examples, the largest diameter of the base conductor member may at least five times larger than the largest diameter of the conductor member. In addition or otherwise, the thickness of the base conductor member may be at least five times larger than the thickness of the conductor member. Each of these dimensions are selected in order to increase the heat dissipation capacity of the base conductor member.

In other examples, the shape of the base conductor member may be substantially identical to the shape of the conductor member. This provides for simpler manufacturing of the anode stack since both the conductor member and the base conductor member can be formed using the same mould.

As is the case with the conductor member, the ratio of thermal expansion coefficient between the base conductor member to the dielectric member may be less than or equal to 3:1, in particular, when the ratio of conductor to dielectric thickness is 1:2, for the same reasons.

As is the case with the conductor member, the base conductor member preferably comprises a material having thermal conductivity above 20 $Wm^{-1}K^{-1}$, for the same reasons. Suitable base conductor member materials include but are not limited to tungsten, molybdenum and copper, or alloys thereof.

As is the case between the main body of the conductor member and the dielectric member, the anode stack may further comprise a brazing, gluing or soldering material between the main body of the base conductor member and the dielectric member for joining the main body of the conductor member and the dielectric member, for the same reasons. Some examples of suitable braze materials include copper, Cusil and Nichoro. However, the braze materials are not limited to these, and depending on whether the dielectric member insulator is coated or uncoated, active or non-active braze materials may be used.

In each of the examples of the anode stack described above, the anode stack may further comprise a layer of material comprising a thermal transfer material arranged between the main body of the conductor member and the high voltage anode in use. In particular, the thermal transfer material may be a graphite based material, which has high thermal conductivity and acts as a good heat exchanger. These graphite based materials are also compliant and fill any small air gaps that arise due to surface roughness between the main body of the conductor member and the high voltage anode in use.

BRIEF DESCRIPTION OF THE DRAWINGS

Certain preferred embodiments of the present invention will now be described by way of example only with reference to the accompanying drawings, in which.

DETAILED DESCRIPTION OF THE EMBODIMENTS

Figure 1:
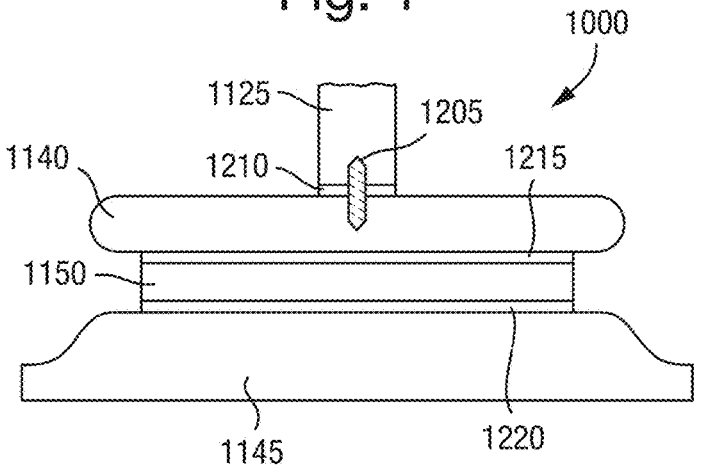
FIG. 1 is an prior art example of an anode stack.

A representation of a prior art anode stack 1000 is shown in FIG. 1. In this figure, two metal conductor plates 1140, 1145 are joined to a dielectric plate 1150 to form a thermally conductive and electrically insulated device for removing heat that is generated in an X-ray tube. Bonding layers 1215, 1220, 1210 are used to join the metal conductor plates 1140, 1145 to the dielectric plate 1150 and for joining the upper conductor plate 1140 to the high voltage anode 1125. A screw 1205 is also used to provide mechanical support between the upper conductor plate 1140 and the high voltage anode 1125.

Although this thermal management system overcomes some of the disadvantages of oil based cooling systems, it also introduces some disadvantages itself. In particular, the perpendicular angles at the edges of the interface between the dielectric 1150 and conductor plates 1140, 1145 causes high electric field strengths to exist at the respective triple point regions, i.e. the regions where the dielectric, metal and vacuum meet. Since the electric field at the triple point region is much greater than the surrounding electric field, electrical arcing and electrical breakdown ensue, which leads to device failure, and this is a prominent problem with the prior art anode stack 1000 of FIG. 1, particularly at high voltages.

Figure 2A:
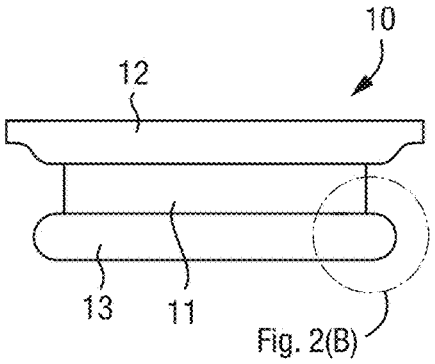
FIGS. 2(A)-(D) illustrate a comparison between the shape of the prior art example of an anode stack of FIG. 1 and an anode stack in accordance with a first example of the present invention.
Figure 2B:
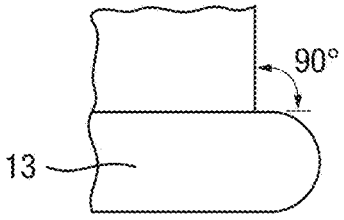
Figure 2C:
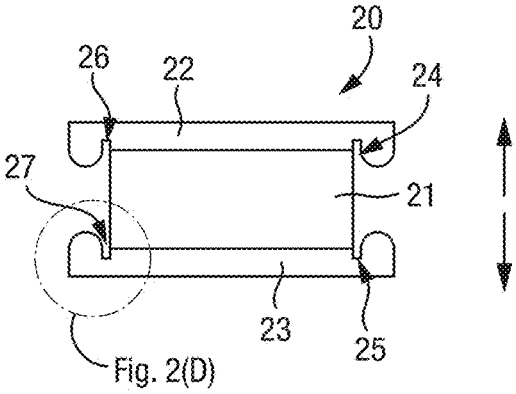
Figure 2D:
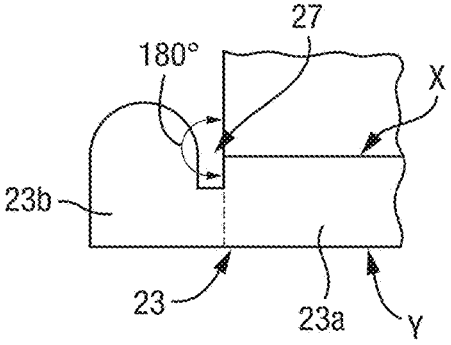

FIG. 2(A) shows the shape of a prior art anode stack 10, namely that of FIG. 1. In contrast, FIG. 2(C) shows an anode stack 20 in accordance with a first example of the present invention. FIGS. 2(B) and 2(D) show expanded views of the joining regions between the conductor members 12, 13 and the dielectric member 11 of the prior art anode stack 10 and the conductor members 22, 23 and the dielectric member 21 of the first example anode stack 20 respectively. In use, a high voltage anode attaches to the conductor members 13, 23 of the prior art and first present invention example respectively.

As explained above with reference to FIG. 1, the perpendicular nature of the interface region in the prior art anode stack 10, as shown in FIG. 2(B), causes high electric fields to build up at the triple point regions between the conductor members 12, 13 and the dielectric member 11. However, as shown in FIG. 2(D), no such sharp angles exist in the first present invention example anode stack 20 in the joining regions 26, 27 (or triple point regions) between the conductor members 22, 23 and the dielectric member 21, the angle in this case being 180 degrees.

In FIGS. 2(C) and 2(D), the anode stack 20 according to the first example of the present invention comprises a conductor member 23 made of tungsten and a dielectric member 21 made of beryllium oxide.

The conductor member 23 has a main body 23*a* and a peripheral portion 23*b*. The dielectric member 21 overlies the main body 23*a* of the conductor member 23 in the sense that the main body 23*a* has a shape which is the geometrical projection of the dielectric member 21, that is, the footprint of the dielectric member 21 is the same shape as the main body 23*a*. The main body 23*a* of the conductor member 23 is coupled with the dielectric member 21 at one planar surface X, and with an end of the high voltage anode at an opposing planar surface Y in use. The peripheral portion 23*b* of the conductor member 23 comprises an annular region that surrounds at least a part (in a vertical direction with respect to FIG. 2(D)) of the dielectric member 21 and which is spaced therefrom, such that the electric field at the triple point region, or joining region 26, is reduced.

The anode stack 20 of this first example further comprises a base conductor member 22 arranged to couple with an opposing surface of the dielectric member 21 to that which couples with the main body 23*a* of the conductor member 23. The base conductor member 22 is identical in shape to the conductor member, i.e. it also has a main body and a peripheral portion.

In the conductor-dielectric-conductor anode stack arrangement of FIGS. 2(C) and 2(D), the respective annular peripheral regions of the conductor member 23 and the base conductor member 22, each surround at least a part of the dielectric member 21 and are spaced therefrom. Thus, these regions extend towards each other somewhat. This provides screening and thus reduces electrical arcing and electrical breakdown at the triple point regions. Accordingly, the reliability of the anode stack 20 of the present invention is greatly increased compared to the prior art anode stack 10 of FIGS. 2(A) and 2(B) whilst maintaining its ability to remove heat from a high voltage anode at a very high rate as well as acting as an electrical insulator.

Two trenches 24, 25 exist in the first example of the present invention, the first grooved in the conductor member 23 and the second grooved in the base conductor member 22. These trenches 24, 25 have a rectangular cross section in the first example of the present invention, but in other examples of the present invention, they may have a square or dome-shaped cross section.

The annular region of the peripheral portions of the two conductor members 22, 23 surround respective joining regions 26, 27 between the dielectric member 21 and the main body of one of the two conductor members 22, 23, said joining regions 26, 27 coinciding with the triple point region of the anode stack 20. The two joining regions 26, 27 each have a perimeter surface which comprises surfaces of the dielectric member 21 and the respective main body of one of the two conductor members 22, 23. As shown in the example of FIGS. 2(C) and 2(D), both the joining regions and each the dielectric member 21 and the main body of each of the two conductor members 22, 23 are cylindrically shaped.

In this cylindrical arrangement, all normal axes to the perimeter surface of the dielectric member 21 and the two conductor members 22, 23 are coplanar. As a result, the electric field in the proximity of these anode stack components and in the joining regions 26, 27 in particular, is reduced further by the removal of sharp edges in said regions. In this example, the joins between the dielectric member 21 and the two conductor members 22, 23 are substantially at 180 degrees. In contrast, the sharp 90 degree angles shown in FIGS. 2(A) and 2(B) at the joins of the prior art anode stack 10 introduces very high electric fields at these joining regions.

An anode stack direction is defined from the dielectric 21 member to each of the two conductor members 22, 23, as shown by the direction of the two arrows in FIG. 2(C). Therefore, the perimeter surfaces of the dielectric member 21 and the two conductor members 22, 23 are cylindrical surfaces of a cylinder whose main axis is parallel with the stack direction in this example. Each of the example anode stacks discussed herein exhibit rotational symmetry about their respective primary axes (parallel to the stack direction).

The anode stack 20 of FIGS. 2(C) and 2(D) is formed by two identical tungsten conductor members 22, 23 in the form of discs that face the thermally conductive beryllium oxide electrical dielectric disc 21. The tungsten discs have a 1.00 inch (25 mm) diameter at its widest part and 0.125 inch (3 mm) thickness, while the beryllium oxide dielectric disc has a 0.75 inch (19 mm) diameter and 0.25 inch (6 mm) thickness. It will be appreciated that the terms "member" and "disc" may be used interchangeably when referring to any example of the present invention.

Machined plane surfaces between the dielectric beryllium oxide disc and the conductive tungsten discs further reduce the electric fields at the triple point regions. Tungsten and beryllium oxide each have thermal conductivities above 20 $Wm^{-1}K^{-1}$ and so they are good thermal conductors.

The ratio of conductor to dielectric thickness is about 1:2 in the example of FIG. 2(C), and so the ratio of thermal expansion coefficient between the conductor members 22, 23 to the dielectric member 21 is about 3:1. This ratio reduces the mechanical stress imparted on the anode stack 20.

Figure 3A:
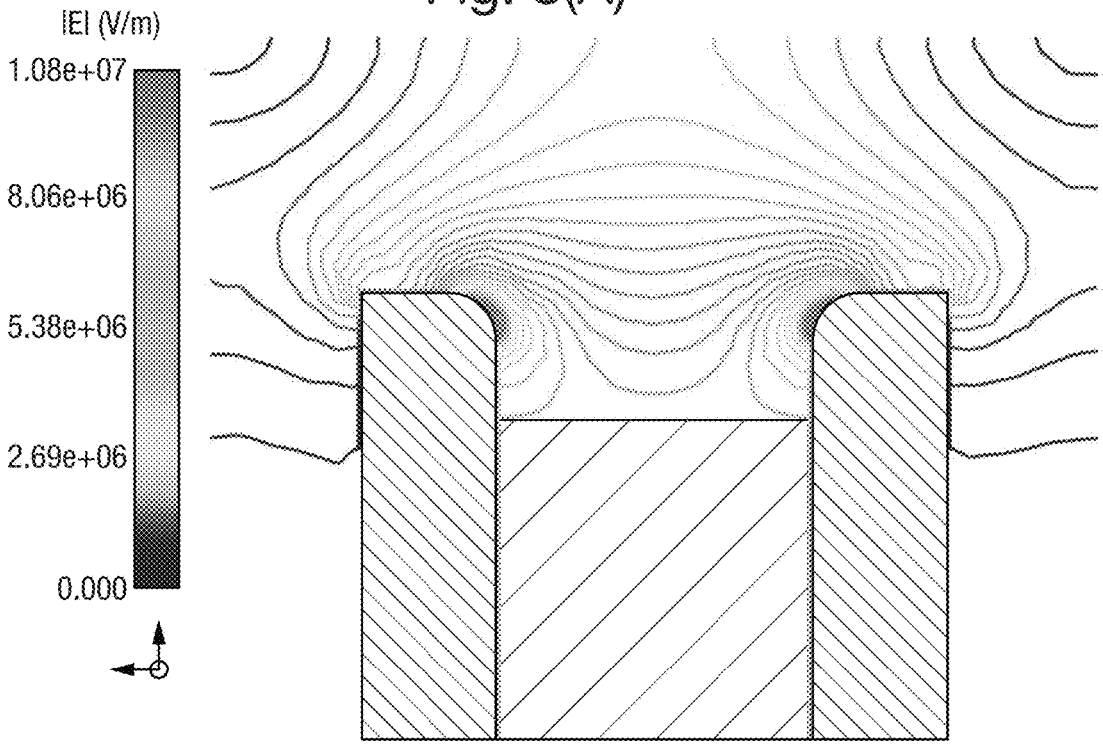
FIGS. 3(A)-(B) show electrostatic analysis performed for the prior art example of an anode stack of FIG. 1 and the first example anode stack of the present invention.
Figure 3B:
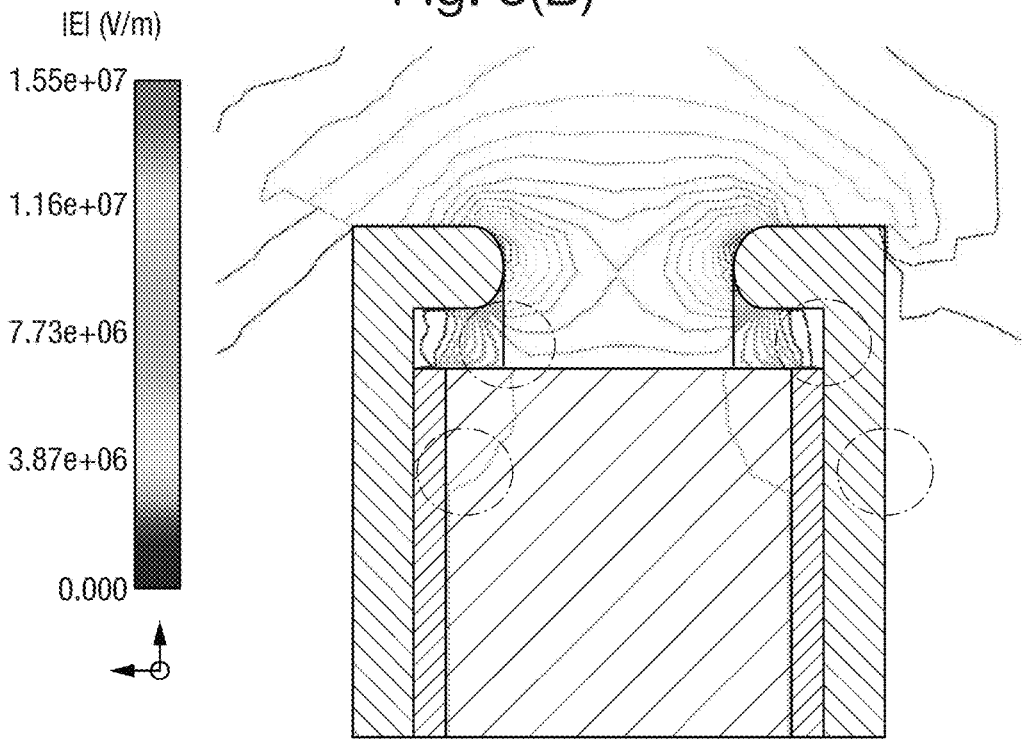

Now turning to FIGS. 3(A) and 3(B), electrostatic analysis results for prior art anode stack 10 of FIG. 1 and the first example of the present invention anode stack respectively are given, which show a decrease of electric field line concentration near the triple point region in the present invention example. The circles in these Figures portray the triple point regions in each design. According to this simulation, high density electric field lines gather at the triple point region of the prior art example of FIG. 3(A), showing up to about 10 V/μm. However, in the present invention example of FIG. 3(B), the electric field density around the triple point region is only about 2 V/μm.

Figure 4:
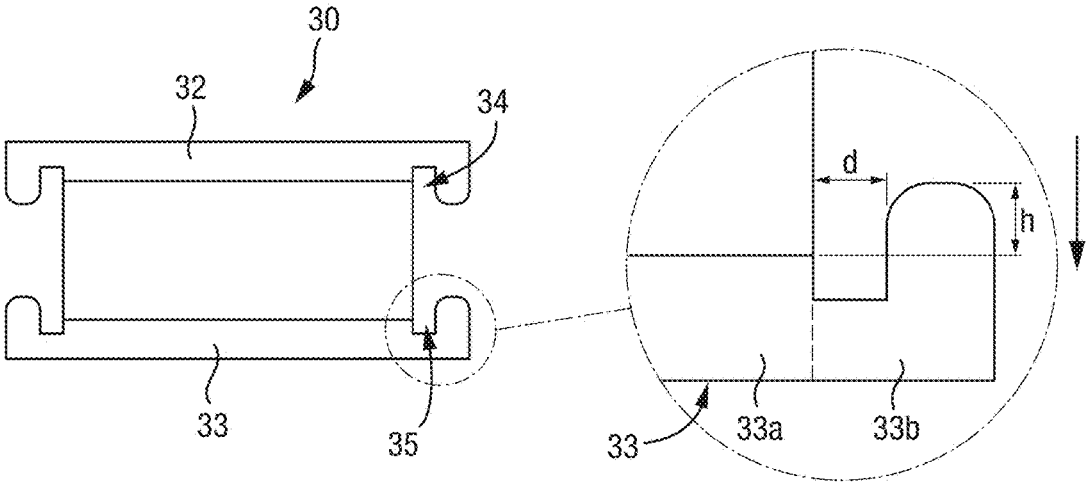
FIG. 4 illustrates an anode stack in accordance with a second example of the present invention.

FIG. 4 shows an anode stack 30 and the dimensions of the trenches 34, 25 of the anode stack 30 in accordance with a second example of the present invention. The second example of the present invention is similar to the first example of the present invention but in the second example, the conductor member 32 and the base conductor member 33 are made of copper. The annular region of the peripheral portion 33*b* of the conductor member 33 defines the trench in the conductor member 33 that extends in the anode stack direction, which is indicated by the direction of the arrow in FIG. 4.

The trench dimensions that are selected determine how greatly the electric field at the triple point regions is reduced compared to an anode stack example without a trench. Its dimensions are preferably selected in such a way that electric field at the triple point regions is reduced by at least two times compared to the case when no trench is used. Electrostatic simulations showed that this two times reduction of electric field is achieved when the extension of conductor above conductor-dielectric interface, height (h), is at least one width (d) of the trench (that is, $h \geq d$).

Trenches of anode stacks according to examples of the present invention generally have a rectangular or square cross section and the top of the peripheral portion is formed generally as a domed or semi-circular shape in cross section.

In the second example of the present invention of FIG. 4, the trench height, h, is shown to be substantially equal to the trench width, d, which is a preferred relative dimension of the trenches 34, 35 for optimising the shielding that the peripheral portion 33*b* provides.

Figure 5:
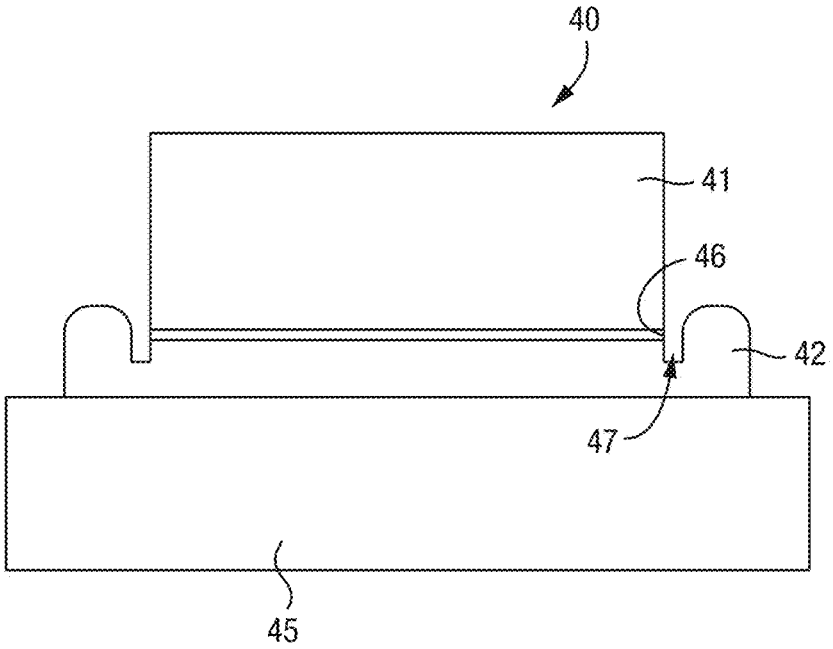
FIG. 5 illustrates an anode stack in accordance with a third example of the present invention.

In the third example of the present invention shown in FIG. 5, the anode stack comprises one grooved metallic disc 42 (i.e. the conductor member) and one ceramic disc 41 (i.e. the dielectric member). The groove in the metallic disc defines the trench 47 and it is adjacent the joining region 46.

In this example, it can be seen that a thin layer of active braze material such as copper or Cusil is provided between the main body of the conductor member 42 and the dielectric member 41. In the other examples, the braze material may be non-active. Selection of braze material depends on thermal expansion coefficients of the materials of the dielectric and conductor members and such braze materials are selected in order to minimise stresses between the dielectric and conductor members. Instead of brazing, other techniques such as gluing or soldering may be used for joining the main body of the conductor member 42 and the dielectric member 41 in other examples of the present invention. The ceramic disc 41 of FIG. 5 is also bonded to a heat sink 45 mechanically using clamps or glued using conductive epoxy.

Electrostatic simulations of this two-part anode stack 40 of the third example of the present invention show maximum electric field to be about 4 V/μm, which is a similar result to the case of three-part anode stack 50 shown in FIG. 6, which will be described below.

Figure 6:
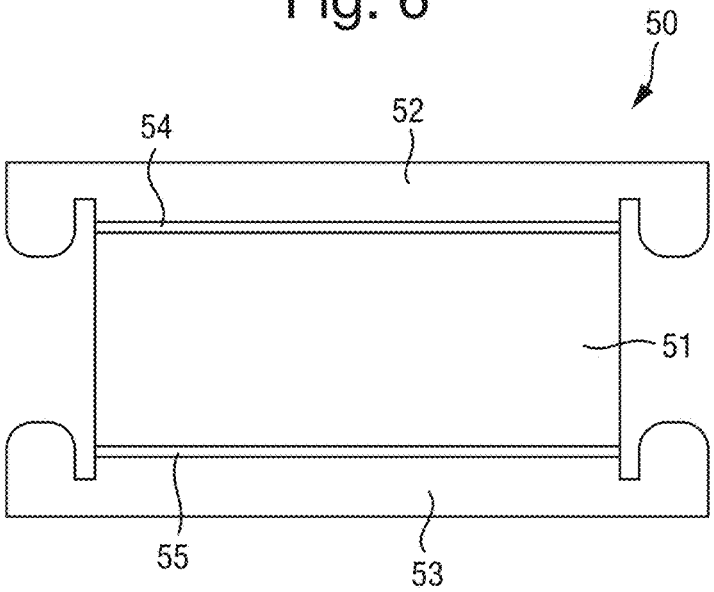
FIG. 6 illustrates an anode stack in accordance with a fourth example of the present invention.

The anode stack 50 according to the fourth example of the present invention shown in FIG. 6 is similar to that of FIG. 5, but it further includes a base conductor member 53 in addition to the conductor member 52 and dielectric member 51. In this configuration, the conductor member 52 is intended for coupling with a high voltage anode in use. The two conductor members 52, 53 are grooved metallic discs and each has a 1 inch (25 mm) diameter at their widest parts, whereas the diameter of ceramic disc 51 is 0.75 (19 mm) inch diameter. In this example, the ceramic disc 51 has a 0.25 (6 mm) inch thickness and the grooved metallic discs each has a thickness of about half of that. Thin layers of active braze material 54, 55 are used to bond the various components together.

Figure 7:
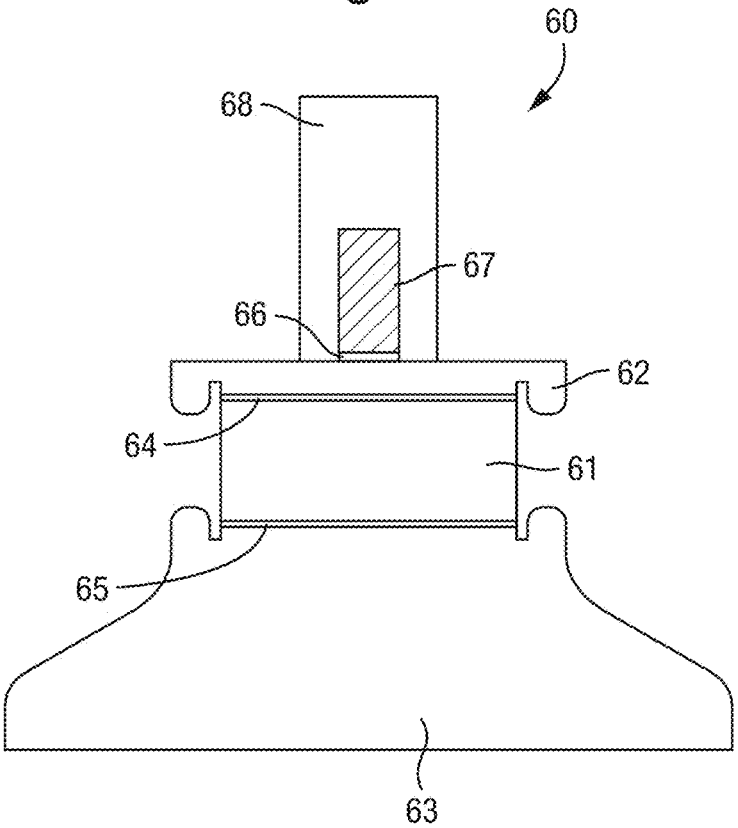
FIG. 7 illustrates an anode stack in accordance with a fifth example of the present invention.

Finally, in FIG. 7, in the fifth example of the present invention, another anode stack 60 according to an example of the present invention is shown. In this example, a large metallic disc 63 (i.e. the base conductor member), a thermally conductive dielectric 61 (i.e. the dielectric member), a metallic disc 62 (i.e. the conductor member) are provided, the thermally conductive dielectric 61 being sandwiched between the metallic discs 62, 63. The metallic disc 62 is also bonded to a high voltage anode 68, and brazing discs 64, 65 are provided between dielectric disc 61 and the two metallic discs 62, 63. Further, a graphite based layer 66 and a metal screw attachment means 67 are provided between the metallic disc 62 and the high voltage anode 68.

In this example, the large metallic disc 63 may connect to a heat sink, and it is larger in both diameter and thickness compared to the other metallic disc 62. This configuration enables increased heat dissipation capacity of the anode stack 60. The largest diameter of large metallic disc 63 can be up to 6 inches, whereas the metallic disc 62 is about 1.5 inches in diameter.

As shown in FIG. 7, a thin round sheet of graphite based material 66 is placed between the mechanically coupled opposing faces of the thermally conductive metallic disc 62 and the high voltage anode 68 in order to improve the heat transfer characteristics of the anode stack 60 from the high voltage anode 68 to the large metallic disc 63.

Graphite based products have extremely high thermal conductivity of between 5,000 and 240,000 $Wm^{-1}K^{-1}$ (depending on the crystal direction), so use of graphite based materials is particularly beneficial for heat exchange applications. The graphite based layer may be brazed onto the metallic disc 62 and the brazing is performed in a vacuum braze oven using a tightly calibrated braze process. This brazing technique is advantageous over techniques, such as bolting, which are less effective for joining electrically dissimilar components together.

The attachment member, which in this case is a metal screw 67, is arranged on the opposing surface of the metallic disc 62 to that which couples with the dielectric disc 61, and it is for attachment with the high voltage anode 67 in use. Mechanically, the metal screw 67 provides much more support between the metallic disc 62 and the high voltage anode 68 than for example mere placement of the high voltage anode onto the anode stack. The metal screw 67 also allows effective heat transfer from the high voltage anode 68 to the conductor member 62.

Aside from use in X-ray devices, other engineering applications that will benefit from the anode stack as described above include heat spreaders for cooling integrated chips, RF transmitting tubes, microwave klystrons, microwave travelling wave tubes, or in other applications where high voltage and high power are used. Additionally, the invention may have uses in high voltage power supplies or in high voltage solid state relays.

The invention claimed is:

1. An anode stack for cooling and electrically insulating an anode of an X-ray device, the anode stack comprising:

a conductor member and a dielectric member, the conductor member having a main body and a peripheral portion, wherein the dielectric member overlies the main body of the conductor member, wherein the main body of the conductor member is arranged to couple with the dielectric member at one surface of the conductor member, and with an end of the anode at an opposing surface of the conductor member, and wherein the peripheral portion of the conductor member comprises an annular region that surrounds at least a part of the dielectric member and which is spaced therefrom.

2. An anode stack according to claim 1, wherein the annular region of the peripheral portion of the conductor member surrounds a joining region between the dielectric member and the main body of the conductor member.

3. An anode stack according to claim 2, wherein the joining region has a perimeter surface comprising surfaces of the dielectric member and of the main body of the conductor member.

4. An anode stack according to claim 3, wherein the joining region is cylindrically shaped.

5. An anode stack according to claim 3, wherein all normal axes to the perimeter surface of the joining region are coplanar or lie in parallel planes.

6. An anode stack according to claim 3, wherein an anode stack direction is defined from the dielectric member to the conductor member along a major axis shared by the dielectric member and the conductor member.

7. An anode stack according to claim 6, wherein the perimeter surface of the joining region is parallel with the stack direction.

8. An anode stack according to claim 6, wherein the annular region of the peripheral portion of the conductor member defines a trench in the conductor member that extends in the anode stack direction.

9. An anode stack according to claim 8, wherein the trench height is substantially equal to the trench width.

10. An anode stack according to claim 1, wherein the dielectric member and the main body of the conductor member are each cylindrically shaped.

11. An anode stack according to claim 1, wherein the ratio of thermal expansion coefficient between the conductor member to the dielectric member is less than or equal to 3:1.

12. An anode stack according to claim 1, further comprising an attachment member arranged on the opposing surface of the conductor member, for attachment with the anode.

13. An anode stack according to claim 12, wherein the attachment member is a metal screw.

14. An anode stack according to claim 1, wherein the conductor member comprises a material having thermal conductivity above 20 $Wm^{-1}K^{-1}$.

15. An anode stack according to claim 1, wherein the dielectric member comprises a material having thermal conductivity above 20 $Wm^{-1}K^{-1}$.

16. An anode stack according to claim 1, further comprising a brazing, gluing or soldering material between the main body of the conductor member and the dielectric member for joining the main body of the conductor member and the dielectric member.

17. An anode stack according to claim 1, wherein the anode stack further comprises a base conductor member arranged to couple with an opposing surface of the dielectric member to that which couples with the main body of the conductor member.

18. An anode stack according to claim 17, wherein the base conductor member has a main body and a peripheral portion, wherein the dielectric member overlies the main body of the base conductor member, wherein the main body of the base conductor member is arranged to couple with the dielectric member, and wherein the peripheral portion of the base conductor member comprises an annular region that surrounds at least part of the dielectric member and which is spaced therefrom.

19. An anode stack according to claim 17, wherein the largest diameter of the base conductor member is at least five times larger than the largest diameter of the conductor member.

20. An anode stack according to claim 17, wherein the thickness of the base conductor member is at least five times larger than the thickness of the conductor member.

21. An anode stack according to claim 17, wherein the shape of the base conductor member is identical to the shape of the conductor member.

22. An anode stack according to claim 21, wherein the ratio of thermal expansion coefficient between the base conductor member to the dielectric member is less than or equal to 3:1.

23. An anode stack according to claim 17 wherein the base conductor member comprises a material having thermal conductivity above 20 $Wm^{-1}K^{-1}$.

24. An anode stack according to claim 17, further comprising a brazing, gluing or soldering material between the main body of the base conductor member and the dielectric member for joining the main body of the base conductor member and the dielectric member.

25. An anode stack according to claim 1, further comprising a layer of material comprising a thermal transfer material arranged between the main body of the conductor member and the anode.

* * * * *